US005190295A

United States Patent [19]

Togni

[11] Patent Number: 5,190,295

[45] Date of Patent: Mar. 2, 1993

[54] TABLE GAME BOARD FORMING A BOOK-SHAPED BOX

[76] Inventor: Louis Togni, Clos Mariane Chemin du Pére-Eternel, Hyeres 83400, France

[21] Appl. No.: 778,085

[22] PCT Filed: Jun. 12, 1990

[86] PCT No.: PCT/FR90/00413

§ 371 Date: Dec. 12, 1991

§ 102(e) Date: Dec. 12, 1991

[87] PCT Pub. No.: WO90/15649

PCT Pub. Date: Dec. 27, 1990

[30] Foreign Application Priority Data

Jun. 13, 1989 [FR] France ..... 89 08077

[51] Int. Cl.[5] ..... A63F 3/00; B65D 79/00

[52] U.S. Cl. ..... 273/285; 206/472; 206/473; 206/315.1

[58] Field of Search ..... 273/285, 287; 206/472, 206/473, 315.1

[56] References Cited

U.S. PATENT DOCUMENTS

| | | | |
|---|---|---|---|
| 2,531,510 | 11/1950 | Heacock | 273/285 |
| 3,946,867 | 3/1976 | McGuire et al. | 206/450 |
| 4,275,887 | 6/1981 | Tateyama | 273/239 |
| 4,907,804 | 3/1990 | Arad et al. | 273/93 R |

FOREIGN PATENT DOCUMENTS

| | | | |
|---|---|---|---|
| 8601832 | 7/1986 | Fed. Rep. of Germany . | |
| 8700907 | 5/1987 | Fed. Rep. of Germany . | |
| 2587906 | 4/1987 | France | 273/285 |
| 2644076 | 9/1990 | France | 273/285 |
| 503955 | 4/1939 | United Kingdom | 273/287 |

OTHER PUBLICATIONS

International Search Report and Annex in French.

International Preliminary Examination Report in French.

*Primary Examiner*—Benjamin H. Layno

*Attorney, Agent, or Firm*—Sandler, Greenblum & Bernstein

[57] ABSTRACT

Table game board forming a book-shaped box is provided with a game board, a panel forming a base of the book-shaped box, a receptacle adjacent to the game board having four sides cooperating with the panel to form a container capable of storing game pieces, and a band connecting one of the plurality of elements to the panel. The game board includes a plurality of folds and at least one cut dividing the game board into a plurality of elements to permit the game board, when the plurality of elements are folded one upon the other, to have substantially the same dimensions of the panel. The panel, the band and the folded plurality of elements forming the book-shaped box, with the panel forming one cover of the hook-shaped box, the band forming a back panel of the book-shaped box, and the folded plurality of elements forming another cover of the book-shaped box. The panel has a thickness which is substantially equal to that of the folded plurality of elements. The game board provides for all games requiring a board in the form of a book or other similar shape, by making the board an element of the box.

20 Claims, 2 Drawing Sheets

TABLE GAME BOARD FORMING A BOOK-SHAPED BOX

BACKGROUND OF THE INVENTION

1. Field of the Invention

The present invention relates to a table game board forming a book-shaped box.

The book-shaped box of the present invention is adapted to present all games necessitating the use of a board in the shape of a book or a similar shape, by making the board an element of the box.

2. Discussion of Background Information

Similar devices manufactured up until now generally comprise a board that may be foldable or not, and a separate storage box, and more often than not, one or more additional boxes adapted to contain the movable elements, counters or dice used for playing. These different boxes naturally increase the manufacturing costs of the game.

There exist game boards constituted of two journalled symmetrical portions comprising edges and enabling a box to be constituted by folding back the two portions one against the other, as has been described, for example, in French Patent Publication No. 2,587,906 to Mr. René BOIS. This device has the disadvantage of necessitating a separate closure element, and in the closed position, its dimensions are necessarily equal to those of half of the board, and this limits the scope of the applications of this game board.

SUMMARY OF THE INVENTION

The device according to the present invention eliminates these disadvantages. Indeed, it enables the elimination of all separate storage boxes, and this enables savings of raw material to be obtained during manufacture, and the game board of the present invention enables a new esthetic appearance to be obtained, and at the same time provides a receptacle for the movable elements during use of the game. Moreover, it enables all party games or others using a board to be brought down to a relatively reduced volume with respect to existing boxes, and this leads to substantial savings in place for the user, storage shelves, transport and other operations. It is constituted of the combination, of a receptacle adjacent to the game board and constituting the sides and the base of the storage box, and acting as storage for the movable elements during the game, with the receptacle being removable, and a special cutting and folding method enabling the folded board to form the top and the back of the storage box, and by giving the assembly the appearance and format of an ordinary book.

BRIEF DESCRIPTION OF THE DRAWINGS

In the annexed drawings, given as nonlimiting examples, of one of the embodiments of the object of the invention.

DETAILED DESCRIPTION OF THE PREFERRED EMBODIMENTS

Figure 1:
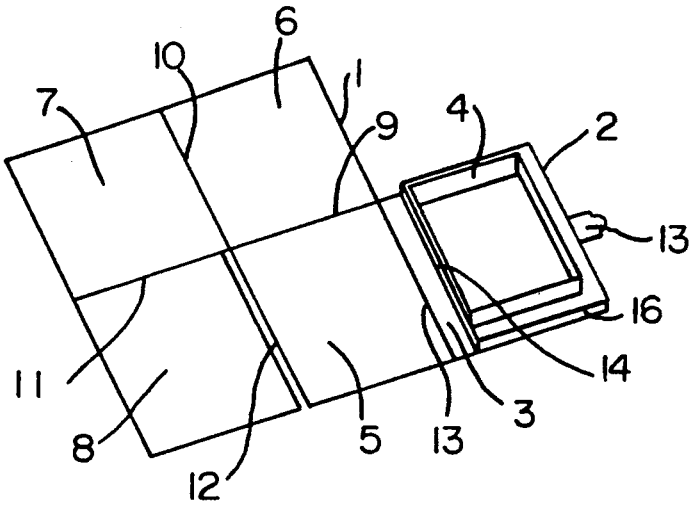
FIG. 1 represents, in perspective, the device in the open use position.
Figure 2:
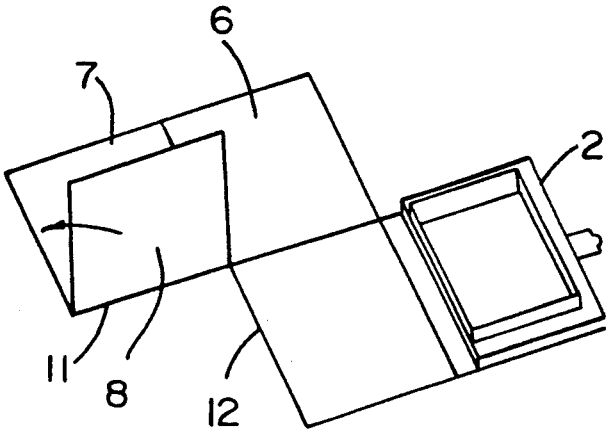
FIGS. 2–5 illustrate different steps of the folding of the board.
Figure 3:
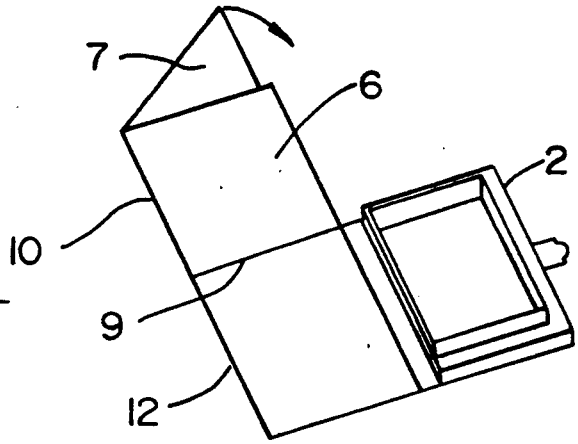
Figure 4:
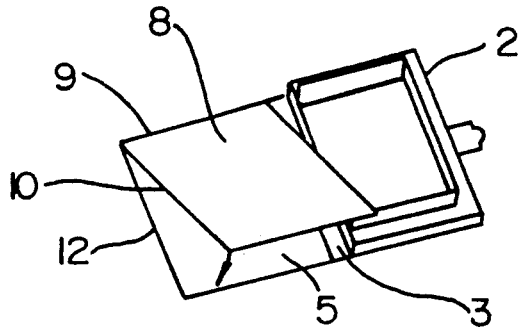
Figure 5:
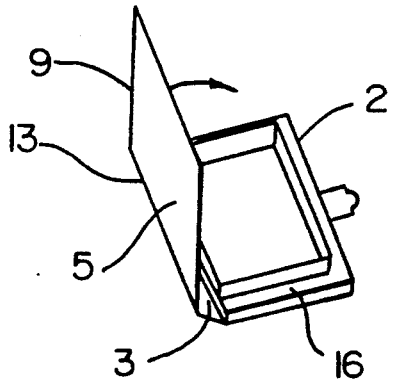
Figure 6:
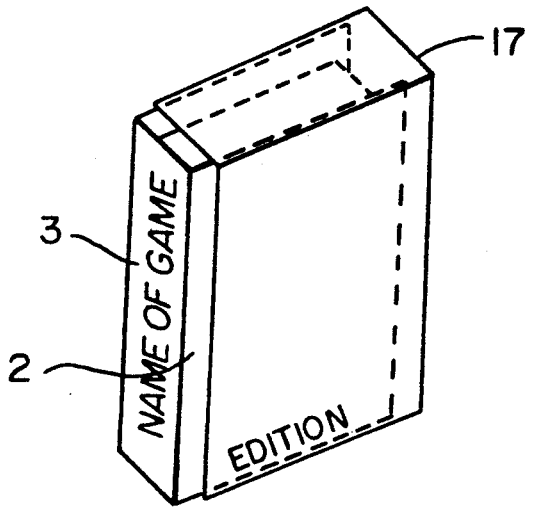
FIG. 6 shows the device in the closed storage position.

The device, FIGS. 1–6, is constituted of a cardboard sheet or a similar material, such as a plastic material, comprising the game board 1 itself, a panel 2 that will become one of the "covers" of the book-box, connected to board 1 by a band 3 adapted to form the "back" of the book in a closed position, the other "cover" being constituted by the folded game board.

Board 1 is formed of four portions 5, 6, 7, 8 separated by premarked folds 9, 10, 11 as well as a cut 12, enabling it to be folded in four. Band 3 also comprises two marked folds 13 and 14 at its junction with board 1 and panel 2.

The cover-panel 2 is equipped with four edges 4, which play a double role: first, they form a receptacle for the movable elements during the game, and secondly, they shape the edges of the "book" in the closed position. The back of panel 2 may receive the rules of the game.

A closure element 13 enables the assembly to be maintained closed, and may be replaced by a case 17 open beside back 3 as well as on the opposite side.

The position of the folds and of the cut is determined in such a manner that the game board 1, once folded, has the exact dimensions of the cover-panel 2. Similarly, the width of band 3 depends on the height of edges 4, the thickness of board 1, and the number of folds in the latter.

The board may be folded into two, into four or more, if necessary, or may be constituted of a single element with dimensions identical to those of panel 2. Moreover, the portions to be folded 6, 7 and/or 7, 8, located at the edge of the board, may be smaller than the others, and this enables the principle of the instant invention to be applied to boards of all dimensions, whatever the dimensions of cover-panel 2.

In a variation of the embodiment, the four edges 4 are provided with a base so as to form a removable box, maintained in place on panel 2 when the device is in the closed position, by a flush contour 16 in the form of a U of its three free edges, the height of said flush contour equal to the thickness of the folded game board 1.

By virtue of its simplicity, its reduced volume, and its low manufacturing costs, the device that has just been described lends itself particularly well to the manufacture of all party games or others, that are played on a table and use a board, such as chess, checkers, or games of the "monopoly" type, etc.

The positioning of the different component elements give this device a maximum number of useful effects, that have not been obtained, up until now, by similar devices.

I claim:

1. A table game board forming a book-shaped box comprising:

a game board;

a panel having dimensions and forming a base of the book-shaped box;

a receptacle positioned adjacent to said game board, said receptacle comprising four sides cooperating with said panel to form a container capable of storing game pieces;

said game board comprising a plurality of folds and at least one cut, said plurality of folds and said at least one cut divide said game board into a plurality of elements to permit said game board, when said plurality of elements are folded one upon the other, to have substantially the same dimensions of said panel;

a band connecting one of said plurality of elements to said panel;

said panel, said band and said folded plurality of elements forming the book-shaped box, said panel forming one cover of the book-shaped box, said band forming a back panel of the book-shaped box, and said folded plurality of elements forming another cover of the book-shaped box; and said panel having a thickness which is substantially equal to that of the folded plurality of elements.

2. The game board according to claim 1, wherein said panel comprises a U-shaped contour flush with free edges of said panel.

3. The game board according to claim 2, wherein the U-shaped contour has a width, and the thickness of said panel comprises the width of said U-shaped contour.

4. The game board according to claim 2, wherein said four sides are directly attached to said panel.

5. The game board according to claim 2, wherein said receptacle includes a base forming a removable box.

6. The game board according to claim 5, wherein said removable box is removably positioned within said U-shaped contour.

7. The game board according to claim 6, wherein said base of said removable box is adjacent said panel.

8. The game board according to claim 2, wherein at least one of said plurality of elements has smaller dimensions than said panel.

9. The game board according to claim 2, wherein said plurality of elements comprise four elements.

10. The game board according to claim 9, including a closure element to maintain the box-shaped book in a closed position.

11. The game board according to claim 1, including a closure element to maintain the box-shaped book in a closed position.

12. The game board according to claim 11, wherein said closure element comprises a clasp.

13. The game board according to claim 11, wherein said closure element comprises a case.

14. The game board according to claim 13, wherein said case has at least one open end.

15. The game board according to claim 14, wherein said case includes opposite open ends.

16. The game board according to claim 1, wherein at least one of said plurality of elements has smaller dimensions than said panel.

17. The game board according to claim 1, wherein said plurality of elements comprise four elements.

18. The game board according to claim 17, wherein said at least one cut comprises one cut.

19. The game board according to claim 17, wherein said at least one cut comprises one cut.

20. The game board according to claim 17, including a closure element to maintain the box-shaped book in a closed position.

* * * * *